United States Patent [19]

Virr et al.

[11] Patent Number: 4,528,945

[45] Date of Patent: Jul. 16, 1985

[54] BOILER AND METHOD OF HEATING LIQUID

[75] Inventors: Michael J. Virr, N. Muskegon, Mich.; Richard Burrows, Crawley, England

[73] Assignee: Stone International Limited, England

[21] Appl. No.: 569,489

[22] Filed: Jan. 9, 1984

Related U.S. Application Data

[63] Continuation-in-part of Ser. No. 309,882, filed as PCT GB 81/00034, Mar. 4, 1981, published as WO 81/02617, Sep. 17, 1981, § 102(e) date Oct. 2, 1981, abandoned.

[30] Foreign Application Priority Data

Mar. 4, 1980 [GB] United Kingdom ..... 8007308

[51] Int. Cl.[3] ..... F22B 1/00

[52] U.S. Cl. ..... 122/4 D; 110/245; 431/170

[58] Field of Search ..... 110/245, 263, 346; 122/4 D; 431/7, 170

[56] References Cited

U.S. PATENT DOCUMENTS

| | | | |
|---|---|---|---|
| 3,970,011 | 7/1976 | Virr et al. | 110/346 |
| 4,184,455 | 1/1980 | Talmud et al. | 122/4 D |
| 4,211,186 | 7/1980 | Pearce | 431/170 |
| 4,227,488 | 10/1980 | Stewart et al. | 122/4 D |
| 4,228,767 | 10/1980 | Smith et al. | 122/4 D |
| 4,279,222 | 7/1981 | Pearce | 431/170 |
| 4,345,894 | 8/1982 | Smith et al. | 110/245 |
| 4,400,150 | 8/1983 | Smith et al. | 431/7 |

*Primary Examiner*—Edward G. Favors
*Assistant Examiner*—Steven E. Warner
*Attorney, Agent, or Firm*—Price, Heneveld, Huizenga & Cooper

[57] ABSTRACT

In a tube boiler, fuel is burned in a fluidized bed which has a shallower part and a deeper part. The tubes extend only through the shallower part which can be fluidized independently of the deeper part so that the rate of heat transfer from the bed to the tubes can be varied according to demand. Water flows through specially configurated, upwardly oriented tubes by natural convection. There is also a general circulation of particles within the bed.

4 Claims, 3 Drawing Figures

BOILER AND METHOD OF HEATING LIQUID

CROSS-REFERENCE TO RELATED APPLICATION

This application is a continuation-in-part of U.S. patent application Ser. No. 309,882, filed as PCT GB81/00034, Mar. 4, 1981, published as WO 81/02617, Sep. 17, 1981, § 102(e) date Oct. 2, 1981, abandoned, by Michael John Virr and Richard Burrows, entitled "BOILER AND METHOD OF HEATING LIQUID"; claiming priority to International Application No. PCT/GB81/00034 filed Mar. 4, 1981, and United Kingdom Application No. 8007308 filed Mar. 4, 1980.

BACKGROUND OF THE INVENTION

This invention relates to a boiler for use in heating water or another liquid to generate steam or another vapor.

BACKGROUND ART

In our published British Patent Specification No. 1,475,991, there is described apparatus in which refuse can be burned in a fluidized bed. The lower boundary of the bed is convex so that a central region of the bed is relatively deep and the bed is shallower in regions adjacent to opposite lateral boundaries of the bed. When the bed is fluidized, there is a general circulation of particles downwardly in the deep region, laterally outwardly and upwardly towards the shallow regions and across the surface of the bed back to the deep region. Refuse is introduced into the deep region of the bed somewhat below the surface of the bed.

In order to avoid the temperature of the fluidized bed of the apparatus disclosed in the aforesaid Specification rising to an excessively high value, tubes containing water extend through the shallower parts of the bed from one end of the apparatus to the opposite end. Air for fluidizing those parts of the bed in which the tubes are submerged can be fed independently of the feeding of fluidizing air to the deeper parts of the bed so that the shallower parts of the bed can remain slumped when the rate of release of heat by combustion is not so high that the bed must be cooled. When cooling is required, water is pumped through the tubes and this water may be used for heating a building.

SUMMARY OF THE INVENTION

According to a first aspect of the present invention, there is provided a boiler comprising a combustion chamber which, in use, contains a fluidized bed of particles, inlet means for admitting a fluidizing gas to the bed and which, in use, defines a lower boundary of the bed, the inlet means including respective parts which lie at different levels so that when an upper surface of the bed is level the bed has a deeper part and a shallower part, charging means for charging combustible material into the deeper part of the bed without depositing the material on the surface of the shallower part of the bed and a plurality of tubes for conveying through the bed fluid which is to be heated, each of said tubes extending through the bed from a lower position to a higher position, whereby the fluid can flow through the tubes by natural convection.

A boiler in accordance with the invention is suitable for the generation of steam and does not require the provision of a pump for pumping water through the tubes.

Said tubes preferably extend through the shallower part of the bed but not through the deeper part.

According to a second aspect of the invention there is provided a method of heating a liquid to generate a vapor wherein the liquid is permitted to flow by natural convection through a plurality of tubes, respective parts of which extend through a shallower part of a bed of particles, the particles are heated by combustion in a deeper part of the bed, said deeper part of the bed is fluidized by feeding a fluidizing gas to the deeper part of the bed and the shallower part of the bed through which the tubes extend is fluidized by feeding a fluidizing gas separately to said shallower part at a rate which is varied in accordance with the pressure of the vapor in a manner to maintain said pressure approximately constant.

DETAILED DESCRIPTION OF THE PREFERRED EMBODIMENTS

EMBODIMENT OF FIG. 1

Figure 1:
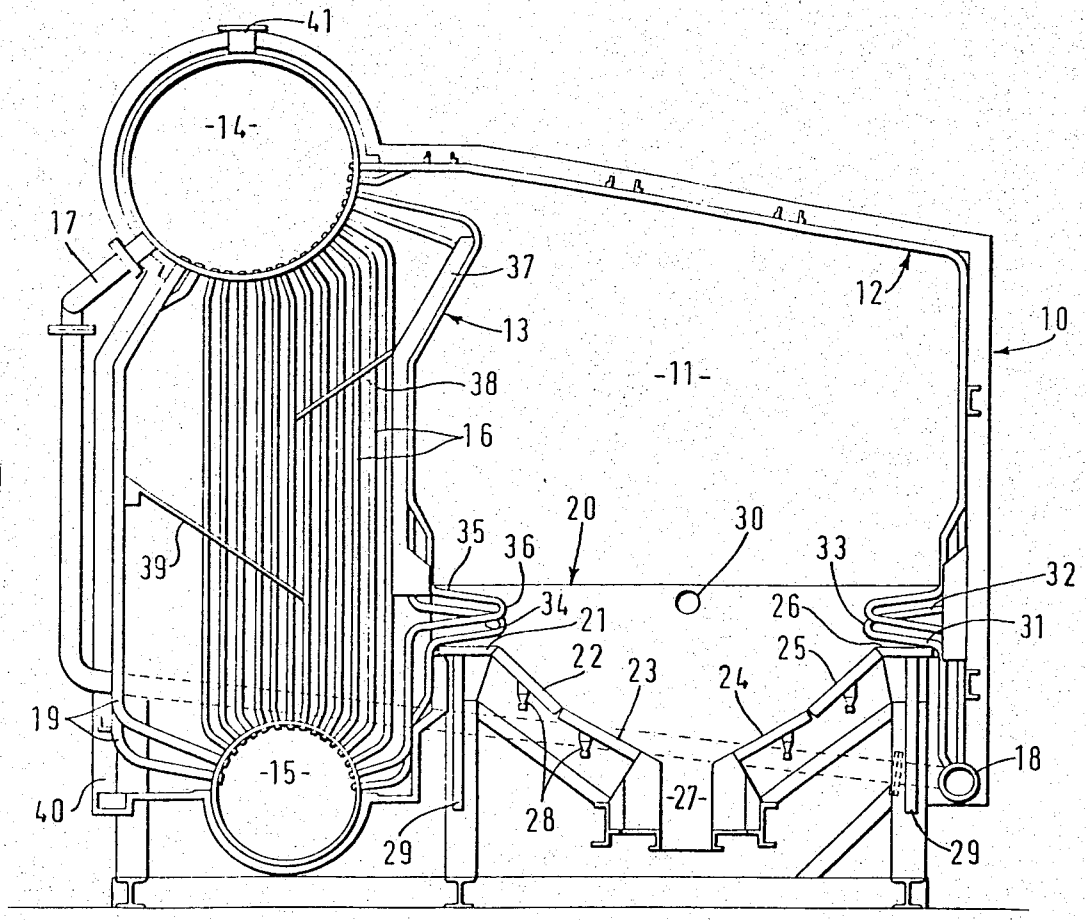
FIG. 1 shows diagrammatically a cross-section in a vertical plane of one example of a boiler embodying the first aspect of the invention and which can be used in a method according to the second aspect of the invention.

The boiler illustrated in FIG. 1 of the drawings comprises a housing 10 within which there is defined a combustion chamber 11. Tubes 12 which are mounted in a single layer on the housing define one lateral boundary and an upper boundary of the combustion chamber. An opposite lateral boundary is defined by a layer of tubes 13. At their upper ends, the tubes 12 and 13 communicate with the interior of a steam drum 14 mounted at the top of the housing 10 to one side of the combustion chamber 11. A water drum 15 is disposed at the same side of the combustion chamber within and adjacent to the bottom of the housing. An array of vertical tubes 16 extends between the drums 14 and 15. The lower ends of the tubes 13 also communicate with the interior of the water drum 15.

A down pipe 17 disposed outside the housing 10 extends from the steam drum 14 to a header 18 with which the tubes 12 communicate at their lower ends. Further down pipes 19 connect the drums 14 and 15.

In a lower part of the combustion chamber 11, there is provided a bed 20 of particles which are fluidized when the boiler is in use. A lower boundary of the bed is defined by inlet means comprising plates 21 to 26 which are formed of porous material or are perforated so that air for fluidizing the bed can be passed through the plates. The plates 23 and 24 are disposed at opposite sides of a discharge opening 27 at the bottom of the bed. The plates 23 and 24 lie at a lower level than do the remaining plates of the inlet means and are inclined upwardly from the opening 27 so that the part of the bed occupying the region directly above the discharge opening and the plates 23 and 24 is relatively deep. Those parts of the bed which lie above the plates 22 and 25 and those parts of the bed which lie above the plates 21 and 26 are shallower. In the particular example illustrated, the plate 22 is inclined upwardly from the plate 23 to the plate 21 which is horizontal. Similarly, the plate 26 is horizontal and the plate 25 is inclined upwardly from the plate 24 to the plate 26.

First feed means 28 is provided for feeding air or a mixture of a gaseous fuel and air, as required, through the plates 22 to 25 into the bed 20. The first feed means may be constructed and arranged as described in our published British patent specification No. 1,428,388. Second feed means 29 is provided for feeding air or other fluidizing gas into the bed through the plates 21 and 26 which form a higher part of the inlet means. The second feed means may be arranged in a known manner and can be operated independently of the first feed means.

In an end wall of the housing 10 there is provided a device 30 for feeding solid combustible material into the deeper part of the bed at a level somewhat below the surface of the bed. The device 30 may be a screw conveyor.

Each of the tubes 12 extends upwardly from the header 18 adjacent to a wall of the housing 10 to a level just above that of the inlet plate 26. At this level, the tube is bent inwardly towards the middle of the combustion chamber to provide a rectilinear, lower inwardly directed limb 31. An upper, rectilinear, inwardly directed limb 32 of the tube lies in the same vertical plane as the lower limb 31 but is spaced upwardly therefrom and is inclined thereto at an acute angle, typically within the range 10° to 30°. The limbs 31 and 32 are united by a bend 33. The limbs 31 and 32 are submerged in that part of the bed 20 which lies directly above the plate 26 and it will be noted that the part of the tube comprising the limbs and the bend 33 extends through the bed from the level of the plate 26 upwardly to the surface of the bed. It will also be noted that the limbs 31 and 32 each extend from a lateral boundary of the bed across the entire width of the shallower part of the bed above the plate 26.

The bends 33 of adjacent tubes 12 lie at respective different levels so that the lower limbs 31 of adjacent tubes are spaced substantially apart and the upper limbs 32 of adjacent tubes also are spaced substantially apart. This provides for free circulation of fluidized particles around the limbs of the tubes.

Each of the tubes 13 includes lower and upper limbs 34 and 35 respectively and a bend 36 arranged in a similar manner to the limbs 31 and 32 and the bend 33 of each tube 12. The tubes 13 extend through the bed from positions adjacent to the plate 21 upwardly to the surface of the bed.

Initially, the bed 20 may comprise particles of sand. Alternatively, the bed may consist of particles of ash. A mixture of gaseous fuel and air is introduced into the bed by the first feed means 28 to fluidize the deeper and intermediate parts of the bed. The mixture is ignited above the bed and combustion spreads downwardly through the bed as the temperature of the bed is raised to the normal operating temperature. The feeding of solid fuel into the bed by the device 30 is then commenced. Provided the calorific value of the solid fuel is sufficiently high, supply of gaseous fuel to the bed is discontinued and the supply of air through the plates 22 to 25 is continued in order to fluidize the bed and to provide air for combustion of the solid fuel.

In consequence of the plates 22 and 25 being at a level different from that of the plates 23 and 24, there is established in the bed 20 a general flow of particles downwardly in the region lying directly above the discharge opening 27, laterally outwardly and upwardly over the plates 23 and 24 to the surface of the bed over the plates 22 and 25 and thence along the surface of the bed to the deeper part of the bed once more. This flow carries fresh solid fuel downwardly in the bed so that small particles of fuel do not escape from the bed before they are burned.

Gaseous products of combustion and any combustible gaseous material evolved from the fuel and not completely burned in the bed rise through the upper part of the combustion chamber 11 where the gaseous combustible material burns. Those parts of the tubes 12 and 13 which lie in the upper parts of the combustion chamber extract some heat from the gases which are confined to the combustion chamber by a wall 37 separating the combustion chamber from the space containing the vertical tubes 16. The hot products of combustion pass over the top of the wall 37 and then downwardly around baffles 38 and 39 which promote contact between the gases and the tubes 16. The gaseous products of combustion leave the housing 10 through a gas outlet 40 adjacent to the water drum 15.

Intermittently, ash and any larger pieces of incombustible material are discharged from the bed 20 through the opening 27 with which there is associated a valve or other closure (not shown).

After the bed 20 has reached its normal operating temperature, air is supplied by the second feed means 29 through the plates 21 and 26 to those parts of the bed through which the tubes 12 and 13 extend. The rate of heat transfer to the tubes 12 and 13 is varied by varying the rate at which fluidizing air is supplied to these parts of the bed. A steam-pressure sensing device (not shown) senses the pressure of steam in the steam drum 14 and an output signal from this device is used to control the second feed means 29 in such a manner that the rate of heat transfer to the tubes is varied to maintain the steam pressure approximately constant.

The temperature of the bed 20 is sensed by means (not shown) which provides an output signal used to control the supply of solid fuel to the bed and the feeding of air to the bed by the first feed means 28. The rate of supply of solid fuel and air is adjusted to maintain an approximately constant bed temperature. In practice, the temperature will vary from one part of the bed to another. The temperature will be lower at a position just below the fuel feed device 30 and the maximum temperature will be achieved in the region above the plates 22 and 25 where the proportion of unburned fuel is small. It will be noted that the tubes 12 and 13 are remote from the position at which solid fuel is introduced into the bed and are adjacent to the hottest parts of the bed.

While it would be within the scope of the invention for some water tubes to extend through a part of the bed lying directly above the plates 22 and 25, in the preferred arrangement illustrated, those parts of the tubes 12 and 13 which are submerged in the fluidized bed lie entirely within the shallower parts of the bed and do not extend through deeper parts of the bed. If the supply of fluidizing gas through the second feed means 29 is discontinued or is avoided during an initial period of operation of the boiler, the shallower parts of the bed will remain slumped and will tend to act as a thermal insulator between the fluidized part of the bed and the submerged parts of the tubes 12 and 13 so that the rate of heat transfer from the fluidized bed to the tubes will be insignificant. The deeper part of the bed can thus be maintained at a temperature above the minimum combustion temperature of the fuel while fuel is supplied at a very low rate to the bed.

Water which is heated in the tubes 12, 13 and 16 rises by convection to the steam drum 14 and cooler water flows to the header 18 and to the water drum 15 via the down pipes 17 and 19. Steam is supplied from the steam drum 14 through a steam outlet 41. It will be noted that no pumps are required to maintain a circulation of water through the tubes.

ALTERNATIVE EMBODIMENT OF FIG. 2

Figure 2:
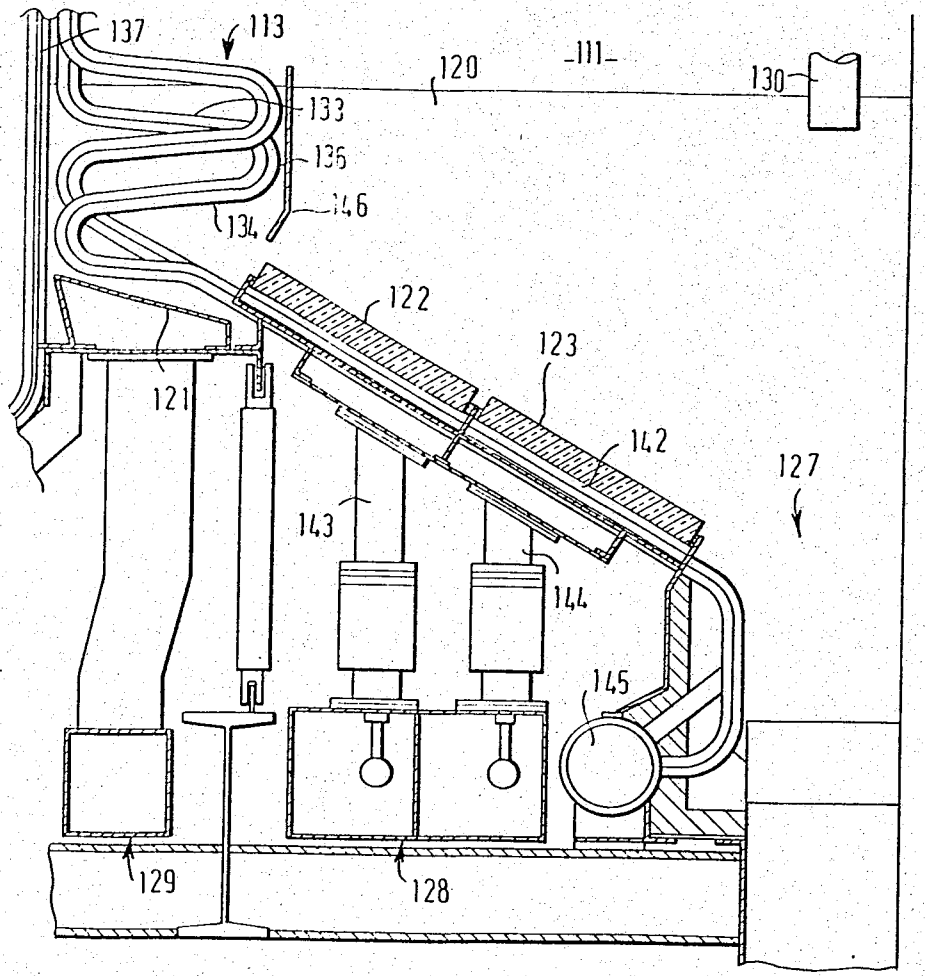
FIG. 2 shows a fragmentary cross-section similar to FIG. 1 of a modified boiler.

In FIG. 2, there is illustrated a boiler incorporating certain modifications, as compared with the boiler of FIG. 1. In FIG. 2, certain parts corresponding to parts already described with reference to FIG. 1 are indicated by like reference numerals with the prefix 1 and the preceding description is deemed to apply to the boiler of FIG. 2, except for the differences hereinafter mentioned.

In the boiler of FIG. 2, plate 122 is aligned with and is inclined upwardly at the same angle to the horizontal as is the plate 123. This angle is typically 30°. With each of the plates 122 and 123, there is associated a respective housing which, in conjunction with the plate, defines a passage 142 which lies at the underside of the plate and extends over the entire area of the plate. A surface of the plate 123 forms one boundary of the passage 142 and the dimension of the passage which is perpendicular to that surface of the plate is small, as compared with other dimensions of the passage. The first feed means 128 of the boiler shown in FIG. 2 includes ducts 143,144 along which air or a mixture of gaseous fuel and air, at the option of the operator, can be fed to the passages associated with the plates 122 and 123 respectively. Similar passages would be associated with the plates 22 and 23 of the boiler shown in FIG. 1.

In the boiler of FIG. 2, lower parts of the tubes 12 extend along the undersides of the plates 122 and 123 in an arrangement such that heat can be transferred from these plates, from the associated housings and from a gaseous mixture passing through the associated passages 142 to water within the tubes 113. Extraction of heat from the passages 142 in his way avoids the risk of a mixture of gaseous fuel and air burning in the passages. The tubes 113 may extend through the passages 142. Alternatively, the tubes may be disposed at the outside of the passages in contact with the housings defining same.

From the plate 142, the tubes 113 extend downwardly to a header 145 disposed near to the discharge opening 127. Parts of the tubes lying between the header 145 and 123 line the discharge opening, or at least an upper part thereof, so that heat is extracted from material occupying the discharge opening.

In the boiler of FIG. 2, the arrangement of first feed means and inlet means at the side of the discharge opening 127 remote from the feed means 128 and inlet means 122 and 123 corresponds to that shown in the drawing.

For introducing fuel into the bed 120 shown in FIG. 2, there is provided a vertical duct 130 extending downwardly from the top of the chamber 111 to a level just below the surface of the bed. The duct 130 is directly above the deepest part of the bed and preferably contains a feed screw.

In the bed 120 shown in FIG. 2, there may be a partition 146 between that part of the bed in which the tubes 113 are submerged and that part of the bed which lies above the plates 122 and 123. This partition is almost entirely submerged in the slumped bed but is spaced upwardly from the inlet means at the bottom of the bed to permit flow of particles past the partition.

ALTERNATIVE EMBODIMENT OF FIG. 3

Figure 3:
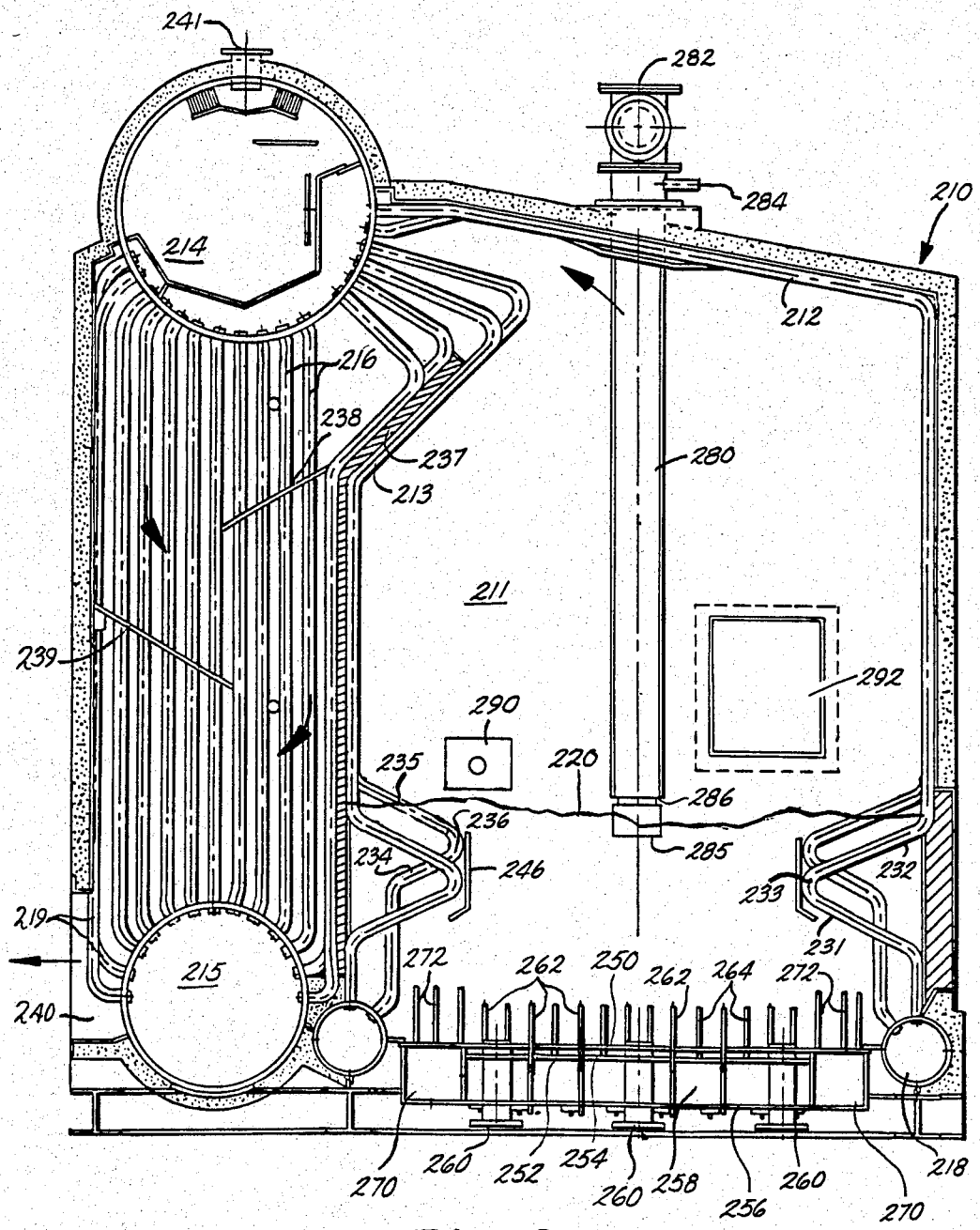
FIG. 3 is a diagrammatic, sectional, elevational view of a third embodiment embodying aspects of the invention.

An alternative preferred embodiment is shown in FIG. 3. The boiler of FIG. 3 includes certain common elements corresponding to elements already described with reference to FIGS. 1 and 2, and therefore are indicated by like reference numerals with the prefix 2 added. The preceding description is deemed to apply to the boiler of FIG. 3, except for the differences hereinafter specifically mentioned.

The boiler of FIG. 3 includes as described above a housing 210, with a combustion chamber 211, tubes 212, tube layer 213, steam drum 214, water drum 215, vertical tube array 216 and down pipes 219. A header 218 is connected to drum 214 by a down pipe (not shown). A particle bed 220 is contained within the lower portion of combustion chamber 211 so as to have a generally level upper surface.

Each tube 212 includes a lower limb 231 and an upper limb 232, positioned and united by a bend 233 in the manner described above in reference to FIG. 1. Similarly, each tube 213 includes a lower and an upper limb 234 and 235 respectively, united by a bend 236. A wall 237 separates combustion chamber 211 from the space containing vertical tubes 216, while two baffles 238 and 239 promote contact between the combustion gases and tubes 216. A partition 246 is shown to separate limbs 231–235 from the center of particle bed 220 as described above.

The alternative embodiment FIG. 3 differs from the embodiments of FIGS. 1 or 2 in the bed containing portion of combustion chamber 211. The lower surface of chamber 211 has a generally flat chamber floor 250 which supports and forms a lower boundary layer of particle bed 220. The portion of the particle bed beneath the top portions of tubes 262 and 264 is slumped, forming an insulative layer during operation. The outlet orifices from these tubes are at the top portions. Spaced directly beneath chamber floor 250 is a divider floor 252 that forms a gas supply plenum 254 between floors 250 and 252. Plenum 254 extends beneath the central portion of particle bed 220 but does not extend toward the walls of chamber 211 sufficiently to be located beneath air tubes 272 and coolant tube limbs 231–235. Spaced beneath divider panel 252 is a lower panel 256 which forms the undersurface of a lower air plenum 258 between panels 252 and 256. Plenum 258 is deeper than plenum 254, and it too does not extend beneath limbs 231 through 235. Extending downwardly through panels 250, 252 and 256 are three ash outlets 260 which are used similarly to outlet 27 of FIG. 1, i.e. to remove ash and any larger pieces of incombustible material from bed 220 through a valve or other closure means (not shown).

Riser tubes 262 and 264 extend upwardly of the bed floor 250. Riser tubes 262 are useful alternately for oil fuel combustion or simply air flow during solid fuel combustion. Each riser tube 262 has an inner oil flow tube that extends from inlet lines (not shown) at the bottom thereof, and upwardly through air plenum 258 and gas plenum 254, having an inlet communicative with lower plenum 258 for air flow. The details are shown in FIG. 5 of U.S. Pat. No. 4,228,767. Riser tubes 264 only have a single tube communicative by orifices with air plenum 258 and by orifices with upper gas plenum 254 (see FIG. 5 of U.S. Pat. No. 4,228,767). Upper plenum 254 is communicative with a gas supply. The riser tubes may include jets or nozzles for desired flow velocity into particle bed 220. Air from plenum 258 is therefore used for supply of combustion air when gas and/or oil are injected, and also for fluidizing particle bed 220 through riser tubes 262 independent of a fuel supply. Fuel flow through riser tubes 262 and 264 is used primarily during start-up of the fluidized bed before bed 220 reaches a level sufficient for burning solid fuel. The start-up as well as continued combustion within chamber 211 may be controlled by control of the gas, air and oil mixture fed into bed 220 through riser tubes 262 and 264. After start-up, solid fuel replaces the fluid fuel provided by riser tubes 262 and 264 as is described in relation to the embodiment of FIGS. 1 and 2.

More detailed descriptions of such riser tube—double plenum arrangements are included in U.S. Pat. No. 4,228,767, issued Oct. 21, 1980 to Willard P. Smith et al; U.S. Pat. No. 4,345,894, issued Aug. 24, 1983 to Willard P. Smith et al; and U.S. Pat. No. 4,400,150, issued Aug. 23, 1983 to Willard P. Smith et al. The disclosures of these patents are specifically incorporated by reference herein.

Since riser tubes 262 and 264 extend upwardly from plenums 254 and 258, riser tubes 262 and 264 are not located beneath tube limbs 231–235. An independent air plenum 270 is located laterally outwardly of plenums 254 and 258, so as to be closer to the outer walls of combustion chamber 211 and beneath the coolant limbs. One plenum 270 is shown located beneath tube limbs 231 and 232, while the other plenum 270 is shown located beneath outwardly extending tube limbs 234 and 235. Plenums 270 are supplied with air but are not communicative with either plenum 254 or 258. An independent control means (not shown) controls the air supply to plenums 270.

Extending upwardly from plenums 270 is a series of riser tubes 272. Riser tubes 272 are communicative with plenums 270 and extend upward from chamber floor surface 250 so as to be higher than riser tubes 262 and 264. Riser tubes 272 are positioned to conduct only air into the portion of bed 220 that lies beneath limbs 231–235. However, due to their greater height, riser tubes 272 introduce air into bed 220 at a level higher than the level at which gas, air, and oil is introduced into bed 220 by riser tubes 262 and 264. The increased height of riser tubes 272 therefore creates a shallower zone to bed 220 that is located beneath and around limbs 231–235, while shorter riser tubes 262 and 264 create a deeper zone of bed 220 at the central portion that is not located beneath limbs 231–235.

With the bi-level riser tube arrangement described above, fluidizing air may be controlled to the shallower zone of bed 220 surrounding limbs 231–235 independent of flow to the deeper zone. Fluidizing air plus fluid fuel may be independently controlled through the remainder of bed 220 by riser tubes 262 and 264. In this manner, the shallower parts of bed 220 above risers 272 may remain slumped in order to act as a thermal insulator for limbs 231–235, while the deeper part of bed 220 above risers 262, 264 may be maintained at a temperature above the minimum combustion temperature, as described above.

An alternative solid fuel feeder 280 which depends from the top of combustion chamber 211 is shown in FIG. 3. Fuel feeder 280 has a solid fuel inlet 282 and an air inlet 284 which flows down an annular chamber around a solid fuel discharge pipe 285. Discharge pipe 285 has its outlet beneath the surface of bed 220 while an air discharge 286 provides a secondary source of air into combustion chamber 211 above the surface of bed 220. Fuel feeder 280 is positioned to discharge solid fuel into the center of bed 220, and therefor discharges into the deeper zone of bed 220 without depositing fuel onto the surface of bed 220 over the shallower zone. Fuel feeder 280 includes controls (not shown) which regulate the flow of solid fuel as well as the flow of air through air inlet 284.

Also shown in FIG. 3 are a pilot light 290 and a hinged access door 292 to combustion chamber 211.

It will be recognized by one skilled in the art that the above is a description of the preferred embodiments and that various modifications and changes may be made without departing from the spirit of the invention disclosed herein. Therefore, the scope of the protection afforded is to be determined by the claims which follow and the breadth of interpretation which the law allows.

We claim:

1. A boiler, comprising:

a fluidized bed combustion chamber, said chamber including a bed containing portion and first and second inlet means for admitting fluidizing gas to said bed containing portion to fluidize a bed of particles contained therein;

said first inlet means introducing fluidizing gas into said bed containing portion at a first upper level to define a shallower zone of said bed containing portion, and said second inlet means being laterally offset from said first inlet means, and introducing fluidizing gas into said bed containing portion at a second deeper level lower than said first level to define a separate deeper zone of said bed containing portion;

said first and second inlet means including riser tubes extending upward through a lower boundary surface, said riser tubes extending upward to be higher at said first inlet means than at said second inlet means;

said first inlet means including a first plenum communicative therewith, and said second inlet means includes a second plenum communicative therewith, said first and second plenum being independent of each other, and said second plenum including an air plenum and a fuel plenum, said air and fuel plenums being independent of each other;

charging means for charging combustible material into a fluidized bed within said bed containing portion above said second inlet means, without depositing combustible material above said first inlet means;

a plurality of tubes positioned within said chamber extending from a lower position to a higher position, each of said tubes having a portion located above said first inlet means in said shallower zone but not above said second inlet means within said deeper zone, each said tube including an upper and a lower limb joined by a bend, said limbs and bend being positioned to extend over said first inlet means within said bed containing portion but not over said second inlet means within said bed containing portion, whereby fluid can flow through said tubes by natural convection and when a fluidized bed of particles is contained within said chamber so as to have a level upper surface, said charging means charges said deeper zone of said bed while not charging said shallower zone.

2. A boiler according to claim 1 wherein, said bed containing portion has a lateral boundary, each of said tubes includes upper and lower limbs extending through said bed shallower zone, said upper and lower limbs being united by a bend, and each of said limbs extending from said bend to said lateral boundary.

3. A boiler according to claim 2 wherein said upper and lower limbs of each tube lie in a common vertical plane, said upper and lower limbs are substantially rectilinear and are mutually inclined at an acute angle.

4. A boiler according to claim 3 wherein said bends of adjacent tubes are located at respective different levels so that said lower limbs of adjacent tubes are spaced substantially apart, and said upper limbs of adjacent tubes also are spaced substantially apart.

* * * * *